US010214402B2

(12) United States Patent
Wu et al.

(10) Patent No.: US 10,214,402 B2
(45) Date of Patent: Feb. 26, 2019

(54) PERSONNEL LIFT VEHICLE

(71) Applicants: Lili Wu, Hangzhou (CN); Nengwen Bao, Hangzhou (CN); Linjie Xu, Hangzhou (CN); Qichen Ma, Hangzhou (CN)

(72) Inventors: Lili Wu, Hangzhou (CN); Nengwen Bao, Hangzhou (CN); Linjie Xu, Hangzhou (CN); Qichen Ma, Hangzhou (CN)

(73) Assignee: BIG LIFT, LLC, Lombard, IL (US)

( * ) Notice: Subject to any disclaimer, the term of this patent is extended or adjusted under 35 U.S.C. 154(b) by 102 days.

(21) Appl. No.: 13/707,169

(22) Filed: Dec. 6, 2012

(65) Prior Publication Data

US 2013/0153336 A1 Jun. 20, 2013

(30) Foreign Application Priority Data

Dec. 14, 2011 (CN) ..... 2011 1 0417715

(51) Int. Cl.
*B66F 11/04* (2006.01)

(52) U.S. Cl.
CPC ..... *B66F 11/04* (2013.01)

(58) Field of Classification Search
CPC ..... B66F 11/04; E04G 1/22
USPC ..... 182/148, 69.4
See application file for complete search history.

(56) References Cited

U.S. PATENT DOCUMENTS 775,373 A * 11/1904 Maxey ..... E04G 1/24 182/145
1,892,687 A * 1/1933 Teufel ..... A47G 25/0685 16/350
2,078,900 A * 4/1937 Biles ..... E01C 19/266 280/43.17
2,106,878 A * 2/1938 Sinclair ..... B66F 9/04 187/225
2,970,523 A 2/1961 Schurger
2,970,667 A 2/1961 Bercaw
2,989,140 A * 6/1961 Hill ..... B66F 11/04 182/148
3,003,573 A * 10/1961 Lorenz ..... B60R 16/04 180/68.5
3,016,973 A 1/1962 Williamson
3,074,500 A * 1/1963 Ulinski ..... B60D 1/075 180/13
3,095,945 A 7/1963 Mitchell
3,113,531 A 12/1963 Barnard
3,172,500 A 3/1965 Dolphin
(Continued)

*Primary Examiner* — Colleen M Chavchavadze
*Assistant Examiner* — Candace L Bradford
(74) *Attorney, Agent, or Firm* — Cook Alex Ltd.

(57) ABSTRACT

The present disclosure relates generally to personnel lift vehicles that include a carriage, a telescoping lift and a load carrying frame. The telescoping lift is connected to a rear portion of the carriage and the load carrying frame is connected to and extends forward from the telescoping lift. The load carrying frame includes a bottom portion that provides an operator platform that is disposed at a central portion of the carriage between a front portion and the rear portion of the carriage. The configuration of the disclosed personnel lift vehicle provides an integral solution for counterweight requirements for the carriage while reducing the overall driving space required for the vehicle.

16 Claims, 12 Drawing Sheets

(56) References Cited

U.S. PATENT DOCUMENTS 3,236,329 A * 2/1966 Price ..... A01D 46/20 182/14
3,282,374 A * 11/1966 Allen ..... B66F 9/06 182/12
3,384,201 A * 5/1968 Fulton ..... A01D 46/20 182/148
3,452,837 A 7/1969 Herrell et al.
3,509,965 A 5/1970 Mitchell
3,596,735 A 8/1971 Denier et al.
3,631,940 A 1/1972 Richins
3,752,261 A 8/1973 Bushnell, Jr.
3,752,263 A * 8/1973 Thevenot ..... E04G 1/20 182/148
3,795,379 A 3/1974 Gray
3,817,346 A * 6/1974 Wehmeyer ..... B66F 11/042 182/14
3,826,393 A * 7/1974 Carroll ..... B66F 9/06 280/43.23
3,844,382 A * 10/1974 Mecklenburg ..... B60L 11/18 187/222
3,856,108 A * 12/1974 Grove ..... B66F 11/046 182/16
3,871,477 A 3/1975 Kuest
3,874,477 A 4/1975 Hedstrom
3,908,849 A * 9/1975 Carroll ..... B66F 9/06 180/209
3,927,732 A * 12/1975 Ooka ..... B66F 11/04 182/152
3,934,681 A * 1/1976 Herrell ..... B66B 9/04 187/253
3,937,301 A 2/1976 Bertail
3,941,213 A 3/1976 Stammen
3,961,681 A 6/1976 Fisher
3,989,118 A 11/1976 Hansen
4,000,787 A 1/1977 Groenig
4,015,686 A 4/1977 Bushnell, Jr.
4,037,896 A 7/1977 Kennedy, Jr. et al.
4,068,737 A * 1/1978 Lenz ..... B66F 11/04 182/146
4,174,086 A * 11/1979 Verberkmoes ..... A47B 5/04 248/242
4,175,644 A * 11/1979 Sikli ..... B66F 3/22 182/141
4,194,591 A * 3/1980 Fisher ..... E04G 1/24 182/101
4,219,302 A 8/1980 Leskovec
4,258,825 A * 3/1981 Collins ..... B66F 11/04 180/321
4,261,438 A 4/1981 Olson
4,392,541 A * 7/1983 Barchard ..... B66F 9/06 180/202
4,397,373 A 8/1983 Ream et al.
4,427,094 A 1/1984 Winkelblech
4,444,284 A 4/1984 Montemurro
4,498,556 A * 2/1985 Garton ..... B66F 11/04 182/19
4,511,015 A 4/1985 Purdy
4,598,797 A * 7/1986 Schultz ..... B66F 17/003 180/271
4,657,112 A * 4/1987 Ream ..... B66F 11/04 182/127
4,906,159 A * 3/1990 Sabo ..... B60L 11/1805 414/273
5,044,472 A * 9/1991 Dammeyer ..... B66F 9/07545 180/273
5,044,473 A 9/1991 Gripe
5,052,521 A * 10/1991 Wendt ..... B66B 9/083 182/148
5,056,655 A * 10/1991 Justice ..... B65G 21/14 198/303
5,105,913 A * 4/1992 Neubauer ..... B66F 11/04 182/148
5,121,816 A * 6/1992 Curtin ..... B66B 9/04 187/243
5,203,425 A * 4/1993 Wehmeyer ..... B66F 11/04 182/113
5,211,410 A * 5/1993 Trubiano ..... B62B 3/144 280/33.993
5,228,538 A * 7/1993 Tremblay ..... B66B 9/00 180/270
5,271,482 A 12/1993 Walz
5,273,132 A * 12/1993 Sasaki ..... B66F 11/04 182/113
5,297,645 A * 3/1994 Eckersley ..... B60K 1/04 180/68.5
5,307,898 A 5/1994 Purdy et al.
D347,720 S 6/1994 Tamara et al.
5,337,858 A * 8/1994 Neubauer ..... B66B 9/16 182/145
5,360,307 A * 11/1994 Schemm ..... B60K 1/04 104/34
D358,925 S * 5/1995 Chung ..... D34/28
5,425,433 A * 6/1995 Huber ..... B66F 11/04 182/145
5,437,939 A 8/1995 Beckley
5,499,694 A * 3/1996 Dorn ..... A61G 5/1059 187/200
5,520,258 A 5/1996 Kemshall
5,584,363 A * 12/1996 Curtin ..... B66B 9/16 187/232
5,657,834 A 8/1997 Plaugher et al.
5,658,120 A * 8/1997 Watanabe ..... B23Q 7/1436 280/781
5,722,505 A 3/1998 Grabner et al.
5,740,887 A 4/1998 Unger et al.
5,755,306 A * 5/1998 Kraemer ..... B66F 11/04 182/148
5,803,204 A * 9/1998 White ..... B66F 11/04 182/148
5,850,892 A 12/1998 Citron et al.
5,875,869 A * 3/1999 Busuttil ..... B66B 9/16 182/148
5,890,559 A 4/1999 Busuttil et al.
5,992,572 A 11/1999 Gilliland et al.
6,000,502 A 12/1999 Leasor et al.
6,174,124 B1 * 1/2001 Haverfield ..... B66F 9/06 182/148
6,241,047 B1 6/2001 Gilliland et al.
6,345,677 B1 * 2/2002 Eckersley ..... B60K 1/04 180/68.5
6,345,694 B1 * 2/2002 Volker ..... B66F 9/07545 187/200
6,378,652 B1 * 4/2002 Albert ..... B66F 11/04 182/148
6,471,004 B2 * 10/2002 Stringer ..... B66F 11/04 182/113
6,561,546 B2 * 5/2003 Puszkiewicz ..... B66F 17/003 212/196
D526,108 S * 8/2006 Gallagher ..... D34/34
7,121,372 B2 * 10/2006 Braud ..... B66F 9/0655 180/210
7,165,776 B2 1/2007 Quinlan, Jr. et al.
7,281,736 B2 10/2007 Sannah et al.
D570,071 S 5/2008 Campbell et al.
7,384,233 B2 6/2008 Segerljung
7,438,318 B2 10/2008 Sano
7,458,588 B2 12/2008 Kallevig
D585,623 S * 1/2009 Quinlan, Jr. ..... D34/34
7,527,118 B2 * 5/2009 Bushinski ..... B62D 55/02 180/209
D640,855 S * 6/2011 Ruppert ..... D34/34
7,967,335 B2 * 6/2011 Bergmeier ..... B66F 9/07559 180/210
8,047,310 B2 11/2011 Kallevig
8,167,069 B2 5/2012 Boegelein et al.
8,191,688 B2 * 6/2012 Bogelein ..... B60K 1/04 180/68.5
D730,614 S * 5/2015 Wu ..... D34/34
2002/0145325 A1 10/2002 Clevenger

(56) References Cited

U.S. PATENT DOCUMENTS

| | | | | |
|---|---|---|---|---|
| 2003/0168286 | A1 | 9/2003 | Brown | |
| 2006/0102363 | A1* | 5/2006 | Tvetene | A01G 20/15 172/20 |
| 2007/0166141 | A1* | 7/2007 | McGrane | B66F 9/07559 414/558 |
| 2008/0116013 | A1* | 5/2008 | Vandewinckel | B62D 51/02 187/229 |
| 2009/0234541 | A1* | 9/2009 | Kramer | B62D 5/049 701/42 |
| 2010/0089703 | A1* | 4/2010 | Gallagher | B62B 3/0612 187/223 |
| 2010/0300784 | A1* | 12/2010 | Bergmeier | B60K 1/04 180/68.5 |
| 2011/0068566 | A1* | 3/2011 | Bartel | A61G 3/061 280/788 |
| 2011/0180349 | A1* | 7/2011 | Beji | B66F 11/04 182/148 |
| 2012/0186908 | A1 | 7/2012 | Crook et al. | |

* cited by examiner

PERSONNEL LIFT VEHICLE

CROSS-REFERENCE TO RELATED APPLICATION

This application claims priority to Chinese Patent Application No. 201110417715.3, filed Dec. 14, 2011, the entire contents of which are hereby incorporated by reference.

FIELD OF THE DISCLOSURE

The present disclosure relates generally to personnel lift vehicles and, more particularly, to personnel lift vehicles that provide a height adjustable operator platform for an operator to move goods onto and off of raised locations or to perform maintenance in an elevated position.

BACKGROUND

Personnel lift vehicles are commonly used, such as in the form of electric picking machines or other equipment needed for storing goods in/on warehouses/racks and picking out goods therefrom. An operator stores goods on and picks goods from different levels by controlling the lifting height of the personnel lift vehicle or electric picking machine, and performing horizontal movement of the goods thereafter. Use of such a machine allows an operator to rise and descend along with the goods. Personnel lift vehicles often are associated with a carriage that may be manually or electrically moved or driven between locations for use in lifting or lowering the operator and goods. Configurations for prior art personnel lift vehicles or electric picking machines tend to have problems involving counterweight requirements to avoid tipping of the vehicle, and driving space requirements that can impair the ability to maneuver through relatively narrow aisles.

SUMMARY

To overcome the disadvantages of the prior art, the present disclosure provides an example personnel lift vehicle having an advantageous configuration that provides enhanced load capacity while inherently addressing the problematic prior art counterweight and driving space requirements, thereby providing for safe and convenient use.

The present disclosure addresses the counterweight requirements without requiring additional ballast in a machine that includes a carriage, a telescoping lift and a load carrying frame. In the example shown, the telescoping lift is in the form of a gantry frame structure. The front portion and the rear portion of the carriage are equipped with wheels and define the direction of the vehicle, and it will be understood that adjusting the installation position of the telescoping lift would result in an adjustment of the configuration of the load carrying frame that is connected thereto.

The load carrying frame is disposed at a central portion of the carriage, and the bottom portion of the load carrying frame provides an operator platform that is located between the front and rear portions of the carriage. With this configuration and the respective location of major systems on the carriage, counter-weighting problems are overcome. The rear portion of the carriage is fixedly connected to the telescoping lift, and the telescoping lift is connected to the load carrying frame. The configuration and mounting of the telescoping lift and of the load carrying frame result in a relatively compact vehicle having an advantageous carriage turning radius while requiring a reduced driving space. The load carrying frame may include an operator platform having a similar width to the load carrying platform, which may facilitate a significantly reduced turning radius and driving space requirement within areas providing for stacked storage.

The driving characteristics and ability to properly adjust the position of the telescoping lift and the load carrying frame are enhanced by having the carriage be equipped with wheels at both the front and rear portions. This permits the operator to locate the load carrying frame in advantageous positions when seeking to pick or place goods relative to aisles and racks.

The rear portion of the carriage is connected to the telescoping lift and may be equipped with a gantry frame fastening spindle to which a gantry frame structure may be connected. The gantry frame fastening spindle permits secure fixation of a relatively wide gantry frame structure, providing for enhanced stability, and therefore, safety. The carriage also may be equipped with an electric motor that drives at least one wheel to rotate. The carriage is further equipped with a storage battery, the storage battery being connected to the electric motor by means of a circuit. The electric motor and storage battery are positioned opposite the telescoping lift, with the lower portion of the load carrying frame that includes the operator platform being disposed therebetween. This further enhances the stability of the carriage by providing a configuration that inherently addresses the counterweight requirements otherwise present in normal operating conditions.

In the event of a desired use in extreme conditions, the carriage may be equipped with counterweight plates. For further safety precautions, the carriage also may be equipped with an emergency lowering control device to prevent an inability of urgently lowering the load carrying frame, in the event of a hydraulic pipe crack or other emergency.

The telescoping lift, if constructed in the form of a gantry frame structure, may include an inner gantry frame, a middle gantry frame and an outer gantry frame, with the inner gantry frame being capable of sliding up and down vertically along the middle gantry frame, and the middle gantry frame being capable of sliding up and down vertically along the outer gantry frame. The inner gantry frame, the middle gantry frame and the outer gantry frame may have a free lifting cylinder system and side rod cylinders disposed in between them, and the up and down movements of the gantry frame structure may be controlled by an electromagnetically operated valve of a hydraulic station. Preferably, the middle gantry frame and the inner gantry frame are equipped with externally disposed cover plates and a free lifting cylinder system, with the side rod cylinders and the wirings of the internal control components being located beneath the cover plates, so that these components are protected and a better appearance is provided.

The load carrying frame preferably may include a front vertical portion, a bottom horizontal portion, a rear vertical portion and a top horizontal portion, with the front vertical portion being connected and perpendicular to the bottom horizontal portion, the bottom horizontal portion being connected and perpendicular to the rear vertical portion, and the rear vertical portion being connected and perpendicular to the top horizontal portion. The front vertical portion and the rear vertical portion may be located at the two ends of the bottom horizontal portion, and the bottom horizontal portion and the top horizontal portion may be located at the two ends of the rear vertical portion. As such, the front end of the top horizontal portion may be connected to the rear vertical portion.

The front end of the front vertical portion preferably is equipped with a load carrying platform in the form of a shelf. The load carrying platform is connected and perpendicular to the front vertical portion. The load carrying frame may use a plurality of rectangular pipes serving as the main load bearing members and force arms, which may provide a structurally simple, integral and practical configuration.

The top horizontal portion at the back of the load carrying frame may cover the top of the telescoping lift for a better appearance, and some small items may be placed on the top horizontal portion as a platform. Preferably, the bottom horizontal portion of the load carrying frame is the location where the operator would stand, and this operator platform rises and descends along with the entire load carrying frame. The operator platform may be equipped with a pedal switch, which may be configured to control the forward and backward movements of the vehicle, which would help ensure the operator is positioned correctly to operate the vehicle and thereby help prevent any incorrect operations by the operator.

The load carrying frame may be equipped with a guard structure, having guards located in areas that constitute "door frames" on one or more sides of the vehicle. The load carrying frame and the "door frames" areas are structurally unified to effectively save materials and to facilitate installation of the guard structure. The guard structure may be equipped with guard shafts that enable the guard structure to pivot upward, to permit an operator to enter and exit the operator platform, and downward to a position for use as a guard to block the operator from inadvertently leaving the load carrying frame. Preferably, the guard structure is gas spring-assisted, and may include an upper guard, a middle guard and a lower guard. The guards are vertically spaced apart. The guard structure may include a control switch, such as the lower guard being equipped with a transducer disposed beneath it, so that the gantry frame structure can only accomplish rising and lowering, and the carriage can only accomplish forward and backward movements when the guard structure has been lowered to its use position, ensuring operational safety. The upper guard on either side may be equipped with one or more operator vehicle controls that may include a steering wheel, a sync Down button, a horn, a coulomb meter, an Up button, a Down button, an emergency stop button, an accelerator and/or a key switch.

The load carrying platform or shelf may be in the form of a grid mesh having a plurality of lateral braces and a plurality of longitudinal braces, with the plurality of lateral braces being perpendicular to the plurality of longitudinal braces. The load carrying platform may be used for holding goods, and is configured in accordance with ergonomic engineering requirements for convenient operator use.

Using the configuration and structures disclosed herein, problems involving counterweight requirements for the entire carriage can be overcome and the driving space requirement of the vehicular machine can be reduced. The central portion of the load carrying frame provides an operator platform location for the operator to stand, and it can rise and descend along with the entire load carrying frame, while the front portion of the load carrying frame also provides a load carrying platform intended for holding goods, and for ergonomically and conveniently permitting movement of goods into and out of storage locations.

In a first aspect, the present disclosure relates to a personnel lift vehicle having a carriage, a telescoping lift and a load carrying frame. The carriage includes a front portion and a rear portion and the telescoping lift is connected to the rear portion of the carriage. The load carrying frame is connected to and extending forward from the telescoping lift. The load carrying frame includes a bottom portion that provides an operator platform that is disposed at a central portion of the carriage between the front and rear portions, and a load carrying platform is connected to and extends forward from the load carrying frame. The front and rear portions of the carriage each have at least one wheel rotatably connected thereto.

In a second aspect, the present disclosure relates to a personnel lift vehicle that includes a carriage, a telescoping lift and a load carrying frame. The carriage includes a front portion having at least one wheel rotatably connected thereto, and a rear portion having at least two wheels rotatably connected thereto, and to which the telescoping lift is connected. The load carrying frame is connected to and extends forward from the telescoping lift, and the load carrying frame includes an operator platform that is disposed between the front and rear portions of the carriage. The vehicle also includes a guard structure that includes at least two guards that are pivotally connected to the load carrying frame, wherein the at least two guards are pivotally movable between at least a first position permitting entry to and exit from the operator platform, and a second position blocking entry to or exit from the operator platform.

In a third aspect, the present disclosure relates to a personnel lift vehicle including a carriage, a telescoping lift and a load carrying frame. The carriage includes a front portion to which at least one front wheel is rotatably connected. A battery, a drive motor and a steering motor are located at the front portion, wherein the drive motor and steering motor are coupled to the at least one front wheel. The carriage also includes a rear portion to which the telescoping lift is connected and to which at least two rear wheels are rotatably connected. The load carrying frame is connected to and extends forward from the telescoping lift and has an operator platform that is disposed between the front and rear portions of the carriage.

Personnel lift vehicles, such as in the form of electric picking machines that are consistent with the present disclosure provide advantages over the prior art in areas including, but not limited to, counterweight and driving spacing requirements.

BRIEF DESCRIPTION OF THE DRAWINGS

The above-mentioned and other features of the present disclosure, and the manner of attaining them, will become more apparent and will be better understood by reference to the following description of exemplary embodiments of the present disclosure, taken in conjunction with the accompanying drawings, wherein.

Figure 1:
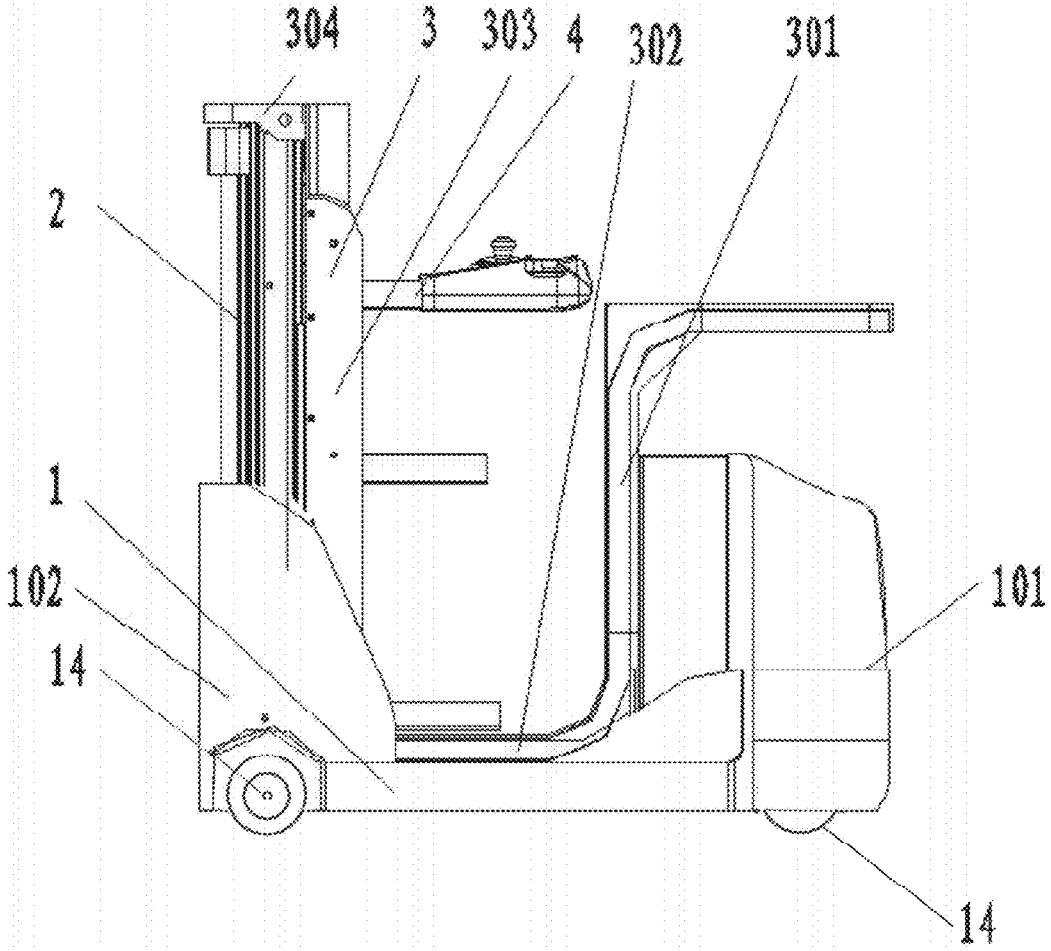
FIG. 1 is an elevation view showing the configuration of a personnel lift vehicle.

Corresponding or related reference numerals indicate corresponding parts throughout the several views. Although the drawings represent exemplary embodiments of the present disclosure, the drawings are not necessarily to scale and certain features may be exaggerated or removed to better illustrate and explain the present disclosure.

DETAILED DESCRIPTION

The present disclosure provides a personnel lift vehicle, which otherwise may referred to as an electric picking machine, and which is described in further detail with reference to the accompanying drawings of the preferred embodiments.

Figure 2:
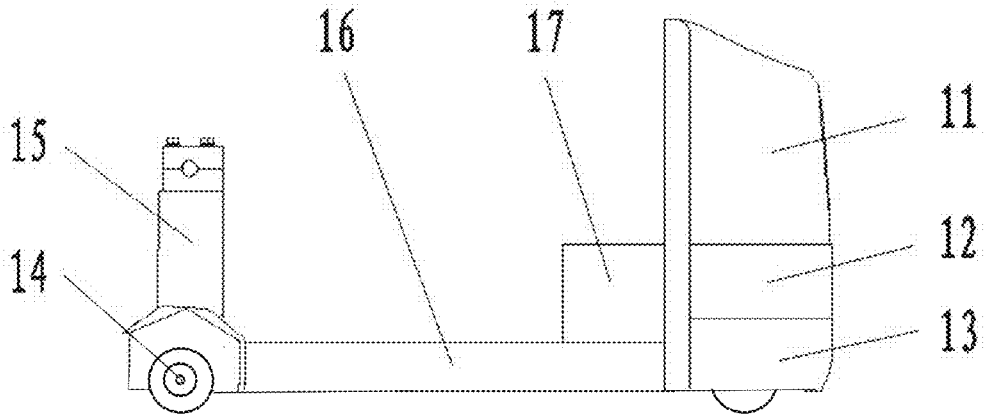
FIG. 2 is an elevation view of the carriage shown in FIG. 1.
Figure 3:
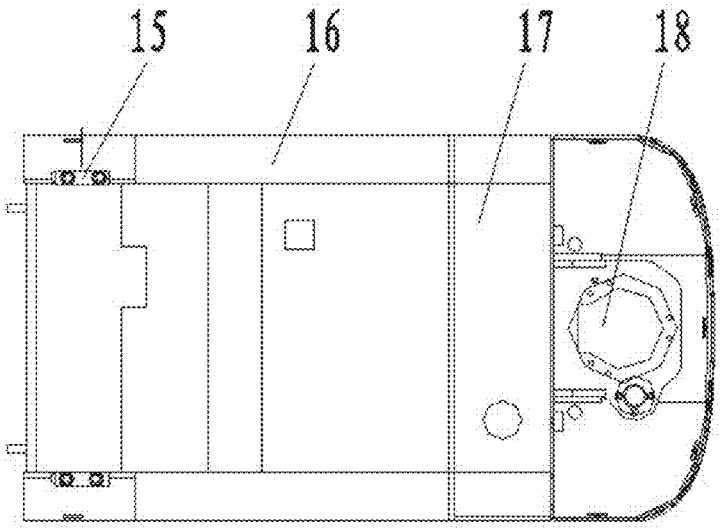
FIG. 3 is a plan view of the carriage shown in FIG. 1.
Figure 4:
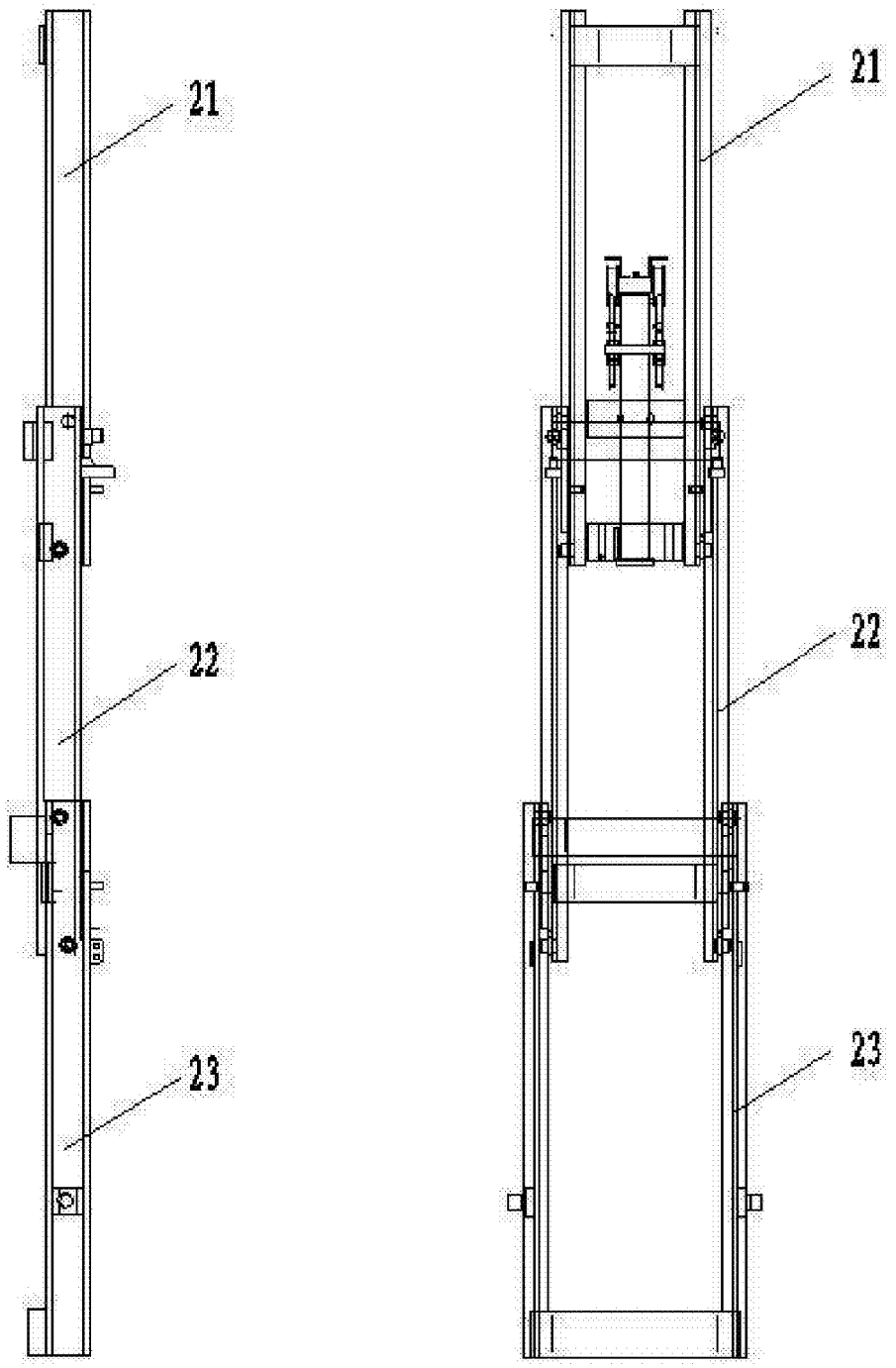
FIG. 4 is a schematic diagram showing the configuration of the telescoping lift in the form of a gantry frame structure shown in FIG. 1.
Figure 5:
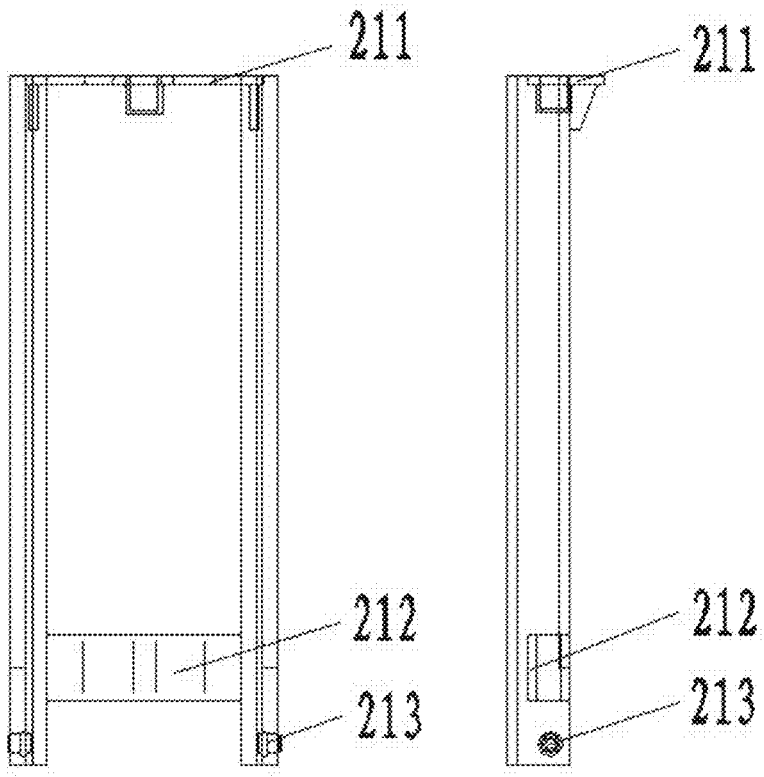
FIG. 5 shows a front elevation and a left side elevation of the inner gantry frame of the gantry frame structure shown in FIG. 4.
Figure 6:
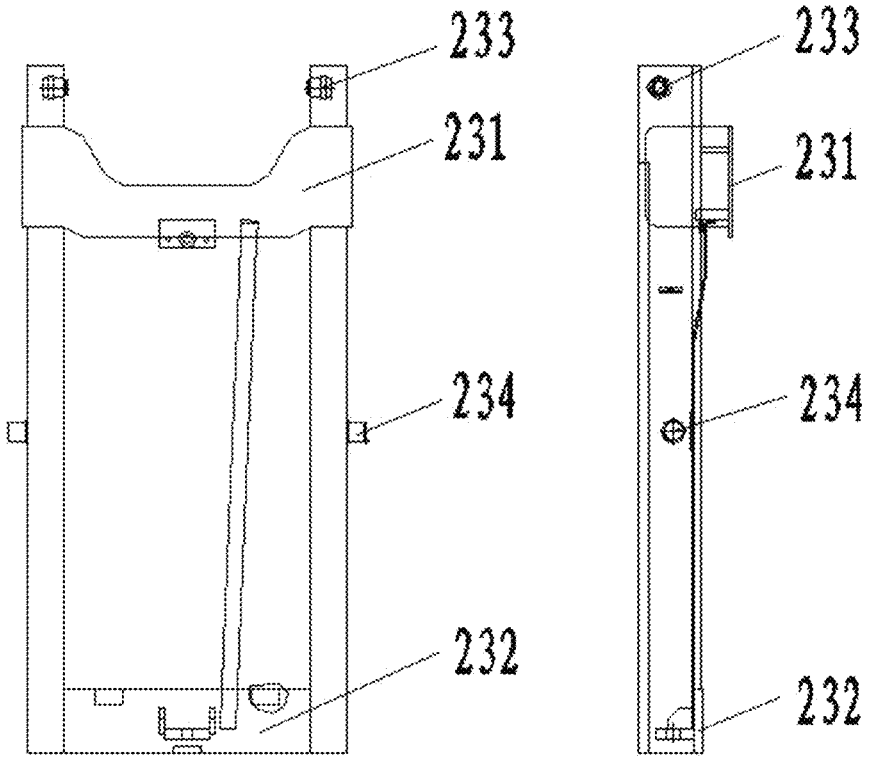
FIG. 6 shows a front elevation and a left side elevation of the outer gantry frame of the gantry frame structure shown in FIG. 4.
Figure 7:
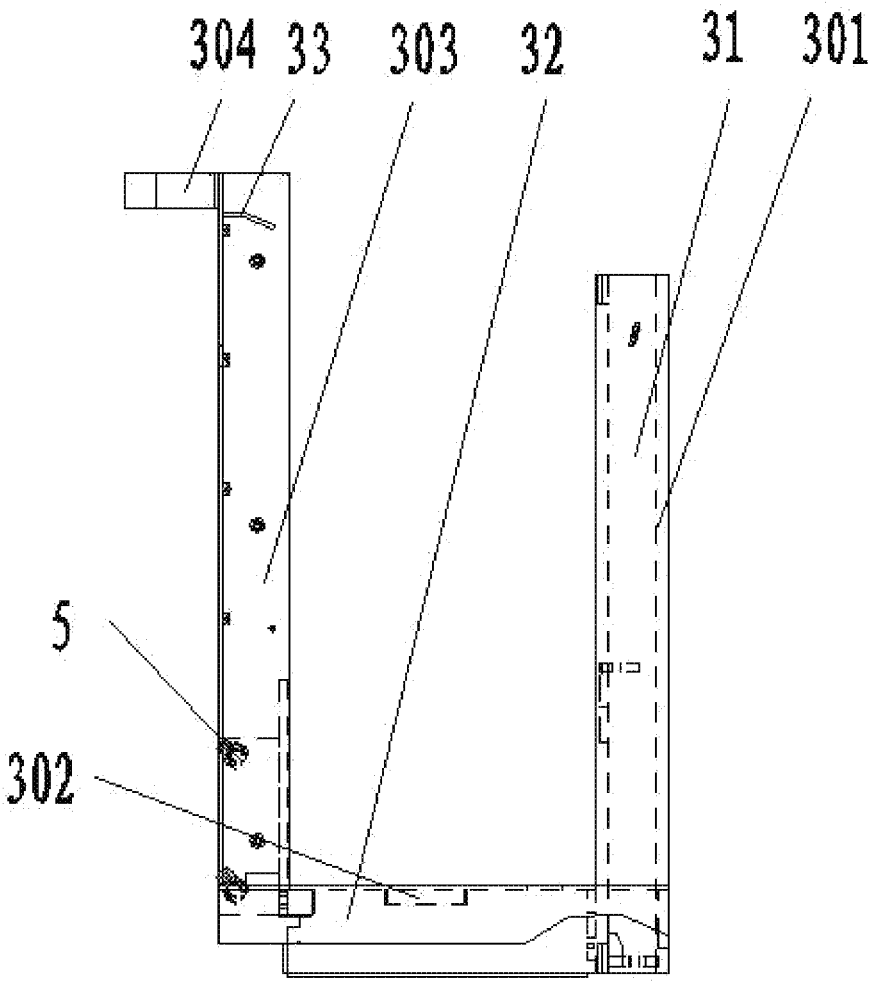
FIG. 7 is an elevation of the load carrying frame shown in FIG. 1.
Figure 8:
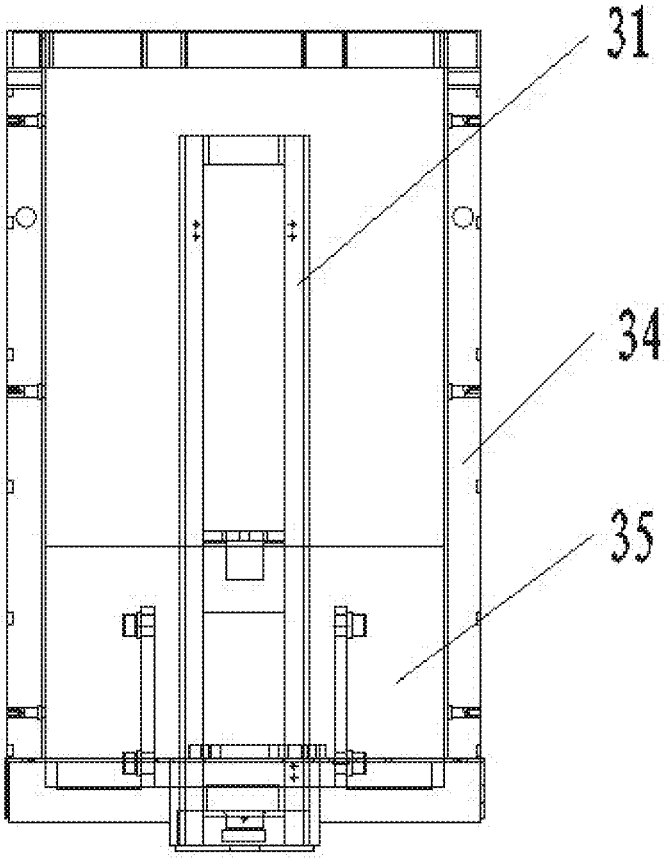
FIG. 8 is a rear elevation of the load carrying frame shown in FIG. 1.
Figure 9:
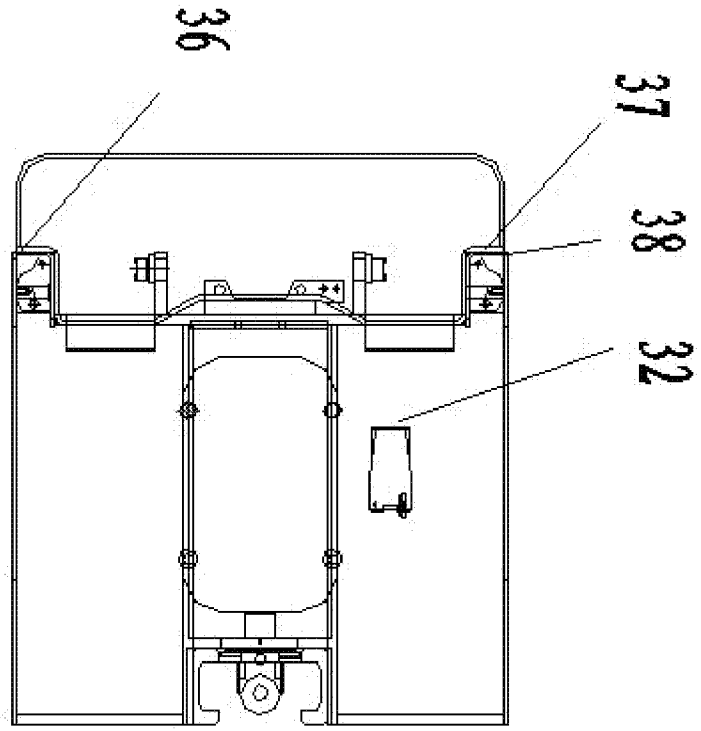
FIG. 9 is a plan view of the load carrying frame shown in FIG. 1.
Figure 10:
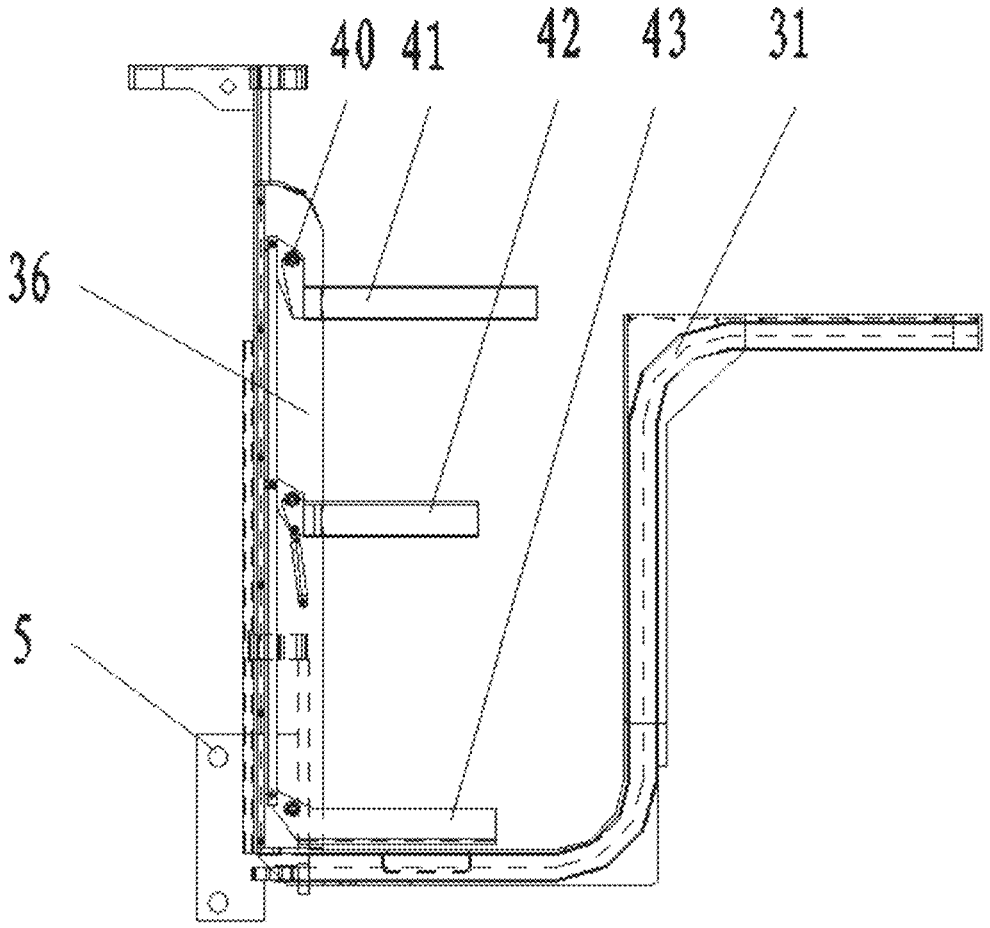
FIG. 10 is a schematic diagram showing the configuration of the load carrying frame and the guard structure shown in FIG. 1 when in use.
Figure 11:
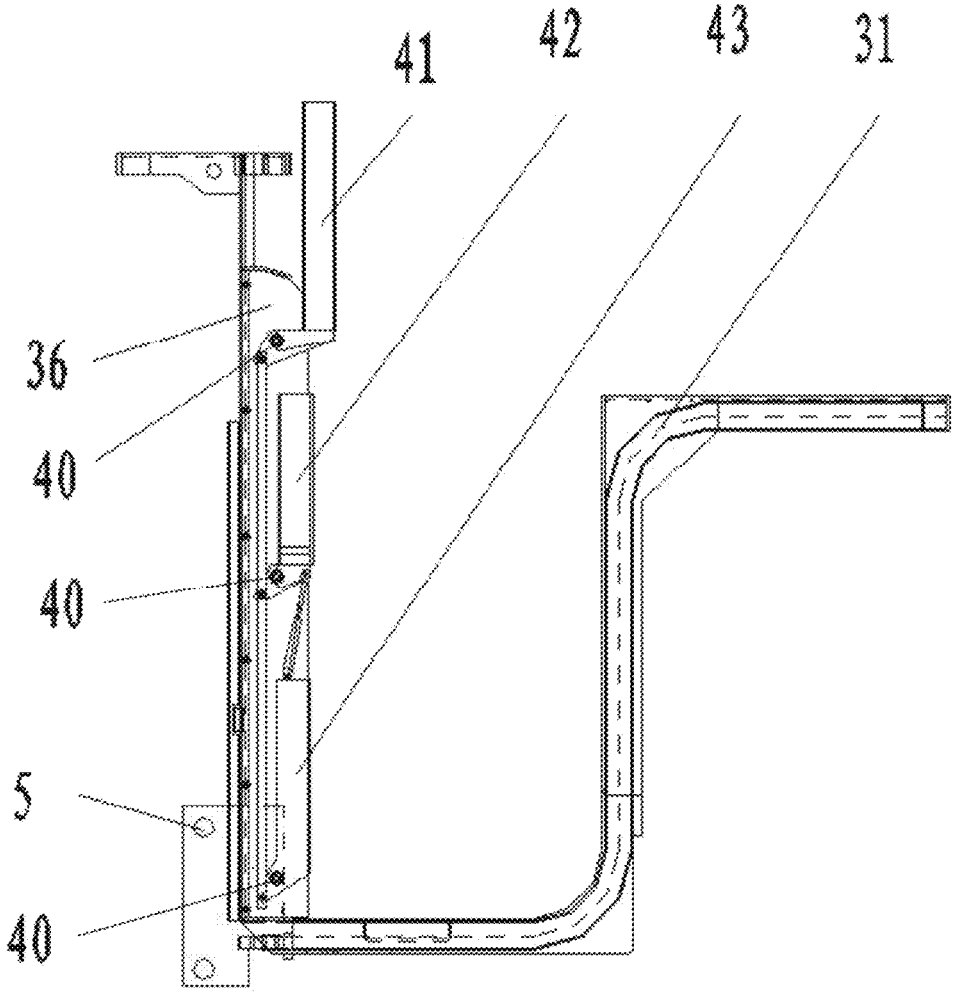
FIG. 11 is a schematic diagram showing the configuration of the load carrying frame and the guard structure shown in FIG. 1 when pivoted upward.
Figure 12:
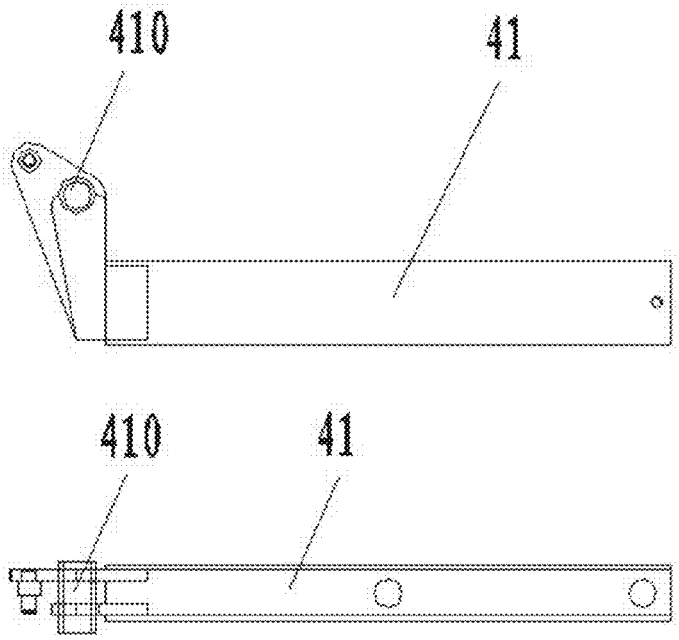
FIG. 12 shows a side elevation and a plan view of a configuration of the upper guard shown in FIG. 1.
Figure 13:
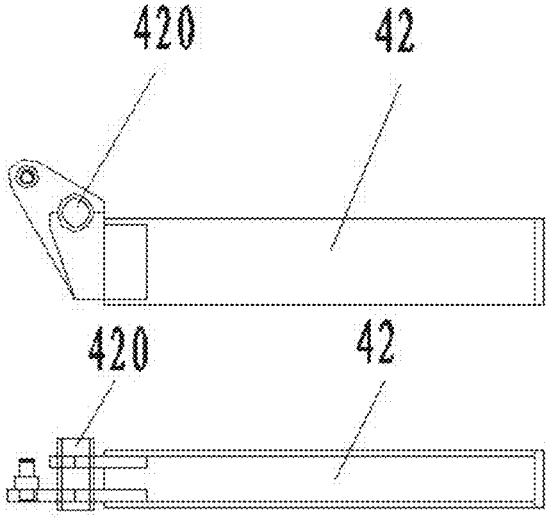
FIG. 13 shows a side elevation and a plan view of a configuration of the middle guard shown in FIG. 1.
Figure 14:
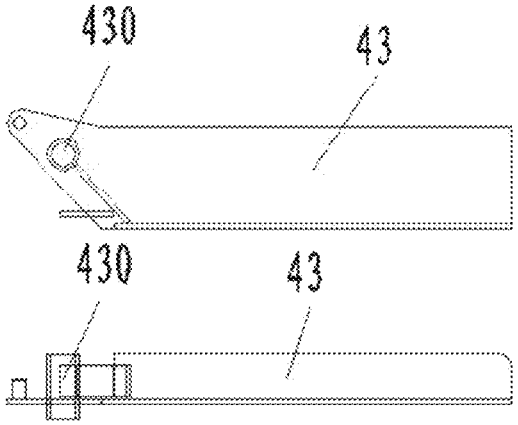
FIG. 14 shows a side elevation and a plan view of a configuration of the lower guard shown in FIG. 1.
Figure 15:
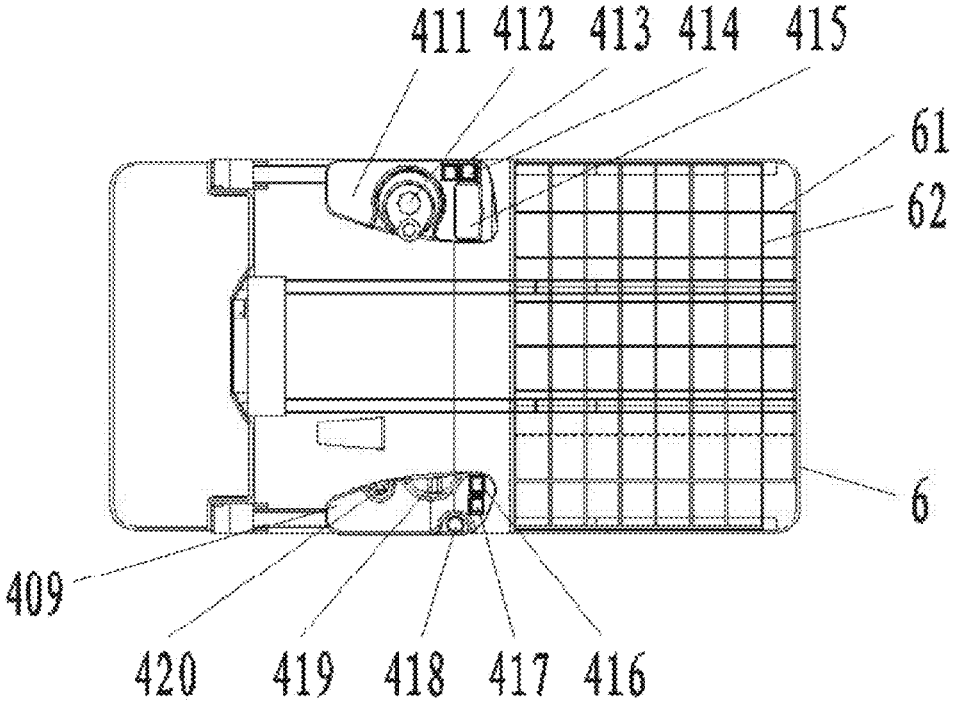
FIG. 15 is a plan view of the personnel lift vehicle shown in FIG. 1.

Turning to FIGS. 1-15, a personnel lift vehicle is disclosed and includes a carriage (1), a telescoping lift (2) and a load carrying frame (3). The carriage (1) comprises a front portion (101) and a rear portion (102), which also define the direction of the machine. In this example, the telescoping lift (2) is shown in the form of a gantry frame structure that is fixedly connected to the carriage (1), and the load carrying frame (3) is connected to the telescoping lift (2).

The carriage (1) includes an upper shroud (12), a lower shroud (13), a gantry frame fastening spindle (15), and a carriage base (16). The front portion (101) and the rear portion (102) of the carriage (1) are equipped with wheels (14), and in this example the wheels include one front wheel and two rear wheels.

The upper shroud (12) and lower shroud (13) are located at the front end of the carriage (1) and cover a compartment at the front portion (101) that accommodates an electric motor (18) that collectively may include a drive motor and a steering motor. The drive motor is drivingly connected to the front wheel (14) to rotate the wheel (14), thereby controlling the forward and backward movements of the carriage (1), while steering of the carriage (1) can be controlled by a gear engagement between the steering motor and the front wheel (14).

Behind the electric motor (18) is a storage battery (17). The storage battery (17) is connected to the electric motor (18) by means of a circuit.

The carriage base plate (16) of the carriage (1) may be equipped with counterweight plates for counterbalancing the weight of goods carried. However, under normal operating conditions, the location of a gantry frame fastening spindle (15) and the telescoping lift in the form of the gantry frame structure (2) at the rear portion (102), and the location of the storage battery (17) and electric motor (18) at the front portion (101), with the load carrying frame (3) located at the central portion therebetween, advantageously provides for integral counterweighting without the need for counterweight plates or other forms of ballast.

In this example, the rear portion (102) of the carriage (1) is equipped with a gantry frame fastening spindle (15), by which the gantry frame structure (2) is fixedly connected to the carriage (1). The gantry frame structure (2) shown includes an inner gantry frame (21), a middle gantry frame (22) and an outer gantry frame (23). The inner gantry frame (21) includes an inner gantry frame upper beam (211), an inner gantry frame lower beam (212) and an inner gantry frame spindle nose (213). The outer gantry frame (23) includes an outer gantry frame upper beam (231), an outer gantry frame lower beam (232), an outer gantry frame spindle nose (233) and an outer gantry frame mounting shaft (234).

In this example, the outer gantry frame (23) is mounted to the carriage (1) by means of the outer gantry frame mounting shaft (234) and the gantry frame fastening spindle (15). The outer gantry frame (23) is connected to the middle gantry frame (22) by means of the outer gantry frame spindle nose (233), and the middle gantry frame (22) is fixedly connected to side rod hydraulic cylinders, with the bottoms of the side rod cylinders being fixedly connected to the carriage (1). The inner gantry frame (21) is connected to the middle gantry frame (22) by means of the inner gantry frame spindle nose (213), and the inner gantry frame (21) is fixedly connected with a free lifting cylinder system. The free lifting cylinder system is connected to the load carrying frame (3) by means of a chain. The inner gantry frame (21) is capable of sliding up and down vertically along the outer gantry frame (23).

The operating mechanism of the telescoping lift, shown for example as the gantry frame structure (2), achieves control of the up and down movements of the gantry frame structure (2) by controlling the electromagnetically operated valve of a hydraulic station or control system. The free lifting cylinder system mounted to the inner gantry frame (21) is first caused to rise, thereby causing the load carrying frame (3) to rise by means of the chain, with the remainder of the gantry frame structure (2) initially remaining stationary. When the free lifting cylinder system has risen to its maximum height, the side rod cylinders mounted to the middle gantry frame (22) begin to rise and the middle gantry frame (22) rises as a result thereof. The chain wheel disposed on the middle gantry frame (22) is equivalent to a traveling pulley, and it drives the chain to cause the inner gantry frame (21) to rise synchronously, and the load carrying frame (3) is eventually driven to rise synchronously.

The load carrying frame (3), in this example, is configured in a U-shape and located at a central portion of the carriage (1). The U-shape provides increased rigidity while connecting the platforms for and operator and goods to the telescoping lift (2). In this example, the load carrying frame (3) is connected to the inner gantry frame (21) by means of contact rollers (5). The load carrying frame (3) comprises a front vertical portion (301), a bottom horizontal portion (302), a rear vertical portion (303) and a top horizontal portion (304). The front vertical portion (301) is perpendicular to the bottom horizontal portion (302), the bottom horizontal portion (302) being perpendicular to the rear vertical portion (303), and the rear vertical portion (303) being perpendicular to the top horizontal portion (304). The front vertical portion (301) and the rear vertical portion (303) are parallel, while the bottom horizontal portion (302) and the top horizontal portion (304) are parallel. The front vertical portion (301) is connected to the bottom horizontal portion (302), the bottom horizontal portion (302) also is connected to the rear vertical portion (303), and the rear vertical portion (303) is connected to the top horizontal portion (304).

In the example shown, the load carrying platform (6) is in a grid-like form having a plurality of longitudinal braces (61) and a plurality of lateral braces (62), enabling convenient placement of goods, without obstructing the operator's vision. The load carrying platform (6) is connected to and extends forward from the load carrying frame (3). In the preferred example, an integral frame configuration is illustrated for the load carrying frame (3), with steel channel sections (31) disposed internally therein and providing support to the front load carrying platform (6). A foot pedal (32) is disposed at the bottom of the load carrying frame (3), where an operator platform is provided on the bottom horizontal portion (302).

The load carrying frame (3) further includes a vertical column (34) mounted by means of a vertical column mounting panel (35). Both sides of the vertical column (34) are equipped with a rear folding panel (37). A left-side gantry frame panel (38) and a right-side gantry frame panel (36) are disposed at each of the rear folding panels (37).

The left-side gantry frame panel (38) and right-side gantry frame panel (36) of the load carrying frame (3) each have a guard structure (4) disposed respectively thereat. The guard structure (4) on each side in this example includes an upper guard (41), a middle guard (42) and a lower guard (43) that are vertically spaced apart from each other. The upper guard (41), the middle guard (42) and the lower guard (43) each have a guard shaft (40) enabling them to pivot upward to a first position that is out of the way to permit entry to or exit from the operator platform, and to pivot downward to a second position or a use position to block entry or exit from the operator platform. For instance, the upper guard (41) is connected to the load carrying frame (3) by means of an upper guard shaft (410). The middle guard (42) is connected to the load carrying frame (3) by means of a middle guard shaft (420). The lower guard (43) is connected to the load carrying frame (3) by means of a lower guard shaft (430). On a given side, the upper guard (41), middle guard (42) and lower guard (43) also are connected by a linkage at their rear that makes them move synchronously when any one of the guards is moved. Thus, for instance, the operator may conveniently pivot the upper guard (41) about the upper guard shaft (410) to raise the upper guard (41) out of the way, while automatically simultaneously pivoting the middle guard (42) and lower guard (43) to their raised positions.

The upper guard (41) on each side has an operational control system disposed thereon for operator vehicle controls. In this example, as shown on the left side, the control system includes a control box (411) having a steering wheel (412), a sync Down button (413), a horn (414), and a coulomb meter (415). On the right side, the control system includes a control box (409) having an Up button (416), a Down button (417), an emergency stop button (418), an accelerator (419) and a key switch (420). The operational control system is configured to permit the convenient, ergonomic operator control of the raising, lowering, switching, steering and emergency stopping of components of the machine, so that an operator standing on the operator platform is allowed to quickly and safely resume his/her position after moving goods onto or off of the load carrying platform (6). Having the operational control system mounted on the respective left and right upper guards (41), significantly economizes the use of space and materials within the operator platform and load carrying frame (3) by having the restraining devices or guards carry the controls, while permitting the controls to be moved out of the way when the operator is entering or exiting the vehicle.

The above merely provides examples, and it will be appreciated that any equivalent variations and modifications shall be included within the scope of patent protection of the inventive subject matter. Additions or alterations may be made to the apparatus or to the methods of using such apparatus without departing from the spirit and scope of the present disclosure, including but not limited to combinations of features that are individually disclosed or claimed herein. For these reasons, the scope of this disclosure is not limited to the above examples but is as set forth in the appended claims.

What is claimed is:

1. A personnel lift vehicle comprising: a carriage, a telescoping lift and a load carrying frame;

the carriage further comprising a front portion and a rear portion;

the telescoping lift being connected to and located at the rear portion of the carriage;

the load carrying frame being connected to and forward of the telescoping lift;

the load carrying frame further comprising a bottom portion that provides an operator platform that is disposed forward of the telescoping lift and located at a central portion of the carriage between the front and rear portions, with the operator platform further comprising an entry to and exit from at least one lateral side thereof;

at least one operator vehicle control located forward of the telescoping lift;

a load carrying platform being connected to and extending forward from the load carrying frame at a height above the operator platform;

the front portion of the carriage having a single front wheel centered laterally relative to the carriage and being rotatably connected to the front portion, and the rear portion of the carriage having at least two wheels rotatably connected thereto;

the front portion of the carriage being forward of the operator platform and including an electric drive motor forward of a battery that powers the electric drive motor, wherein the electric drive motor drives the carriage by rotating the single front wheel forward and backward, and wherein an electric steering motor is forward of the battery and is connected to and directionally steers the single front wheel to steer the carriage; and wherein inherent counterweighting is provided by having the electric drive motor, electric steering motor and battery located at the front portion and the telescoping lift located at the rear portion, with the operator platform disposed therebetween.

2. The personnel lift vehicle according to claim 1, wherein the telescoping lift includes a gantry frame structure.

3. The personnel lift vehicle according to claim 2, wherein the rear portion of the carriage is equipped with a gantry frame fastening spindle to which the gantry frame structure is connected.

4. The personnel lift vehicle according to claim 2, wherein the gantry frame structure further comprises a nested inner gantry frame, middle gantry frame and outer gantry frame, with the inner gantry frame being capable of sliding up and down vertically along the middle gantry frame, and the middle gantry frame being capable of sliding up and down vertically along the outer gantry frame.

5. The personnel lift vehicle according to claim 1, wherein the load carrying platform further comprises a plurality of lateral braces and a plurality of longitudinal braces.

6. The personnel lift vehicle according to claim 1, wherein the load carrying frame comprises a front vertical portion, a bottom horizontal portion, a rear vertical portion and a top horizontal portion, with the front vertical portion being connected and perpendicular to the bottom horizontal portion, the bottom horizontal portion being connected and perpendicular to the rear vertical portion, and the rear vertical portion being connected and perpendicular to the top horizontal portion.

7. The personnel lift vehicle according to claim 6, wherein the load carrying platform is constructed as an integral part of the load carrying frame.

8. The personnel lift vehicle according to claim 1, further comprising a guard structure that is connected to the load carrying frame.

9. The personnel lift vehicle according to claim 8, wherein the guard structure includes at least two guards that are pivotally connected to the load carrying frame.

10. The personnel lift vehicle according to claim 9, wherein the at least two guards are pivotally movable within separate respective vertical planes between at least a first position permitting entry to and exit from the operator platform, and a second position blocking entry to or exit from the operator platform.

11. The personnel lift vehicle according to claim 8, wherein the guard structure further comprises a pivotal upper guard having a first position permitting entry to and exit from a lateral side of the operator platform, and a second position blocking entry to or exit from the operator platform and having a control box that includes the at least one operator vehicle control, wherein the control box is directly connected to and pivots with the pivotal upper guard.

12. The personnel lift vehicle according to claim 11, wherein the at least one operator vehicle control includes one or more of a steering wheel, a sync Down button, a horn, a coulomb meter, an Up button, a Down button, an emergency stop button, an accelerator and a key switch.

13. A personnel lift vehicle comprising: a carriage, a telescoping lift and a load carrying frame;

the carriage further comprising a front portion having a single front wheel centered laterally relative to the carriage and being rotatably connected to the front portion, and having an electric drive motor forward of a battery, wherein the electric drive motor is connected to and drives the carriage by rotating forward and backward the single front wheel, and wherein an electric steering motor is forward of the battery and is connected to and directionally steers the single front wheel to steer the carriage;

the carriage further comprising a rear portion having at least two wheels rotatably connected thereto, and having the telescoping lift connected to and located at the rear portion;

the load carrying frame being connected to and extending forward from the telescoping lift, wherein the load carrying frame includes an operator platform that is disposed forward of the telescoping lift and located at a central portion of the carriage between the front and rear portions of the carriage;

a load carrying platform being connected to and extending forward from the load carrying frame at a height above the operator platform;

a guard structure that includes at least two guards that are pivotally connected to the load carrying frame on separate vertically spaced apart horizontal axes, wherein the at least two guards are pivotally movable between at least a first raised position permitting entry to and exit from a lateral side of the operator platform, and a second lowered position blocking entry to or exit from the operator platform; and wherein at least one of the at least two guards that are pivotally connected to the load carrying frame has a control box that is directly connected to and pivots with the at least one pivotally connected guard and wherein the control box includes at least one operator vehicle control.

14. The personnel lift vehicle according to claim 13, wherein the at least two guards are vertically spaced apart and connected to the same side of the load carrying frame.

15. The personnel lift vehicle according to claim 14, wherein the at least two guards are connected by a linkage, such that pivoting one of the guards causes pivoting of another of the guards.

16. A personnel lift vehicle comprising: a carriage, a telescoping lift and a load carrying frame;

the carriage further comprising a front portion having a single front wheel centered laterally relative to the carriage and being rotatably connected thereto;

a battery, an electric drive motor and an electric steering motor located at the front portion, with the electric drive motor and electric steering motor located forward of the battery, wherein the electric drive motor drives the carriage by rotating the single front wheel forward and backward and the electric steering motor directionally steers the single front wheel to steer the carriage;

the carriage further comprising a rear portion to which at least two rear wheels are rotatably connected;

the telescoping lift being connected to and located at the rear portion;

the load carrying frame being connected to and forward of the telescoping lift and having an operator platform that is disposed forward of the telescoping lift and located at a central portion of the carriage between the front and rear portions of the carriage, with the operator platform further comprising an entry to and exit from at least one lateral side thereof;

a load carrying platform being connected to and extending forward from the load carrying frame at a height above the operator platform; and wherein inherent counterweighting is provided by having the electric drive motor, electric steering motor, and battery located at the front portion and the telescoping lift located at the rear portion, with the operator platform disposed therebetween.

* * * * *